US009250019B2

(12) United States Patent
Han et al.

(10) Patent No.: US 9,250,019 B2
(45) Date of Patent: Feb. 2, 2016

(54) PLATE HEAT EXCHANGER

(75) Inventors: Sang Chul Han, Daegu (KR); Sin Il Choi, Daegu (KR); Jang Ki Lee, Daegu (KR)

(73) Assignee: Korea Delphi Automotive Systems Corporation, Daegu (KR)

( * ) Notice: Subject to any disclaimer, the term of this patent is extended or adjusted under 35 U.S.C. 154(b) by 1003 days.

(21) Appl. No.: 13/387,211

(22) PCT Filed: Jul. 23, 2010

(86) PCT No.: PCT/KR2010/004849
§ 371 (c)(1),
(2), (4) Date: Jan. 26, 2012

(87) PCT Pub. No.: WO2011/013950
PCT Pub. Date: Feb. 3, 2011

(65) Prior Publication Data

US 2012/0118548 A1 May 17, 2012

(30) Foreign Application Priority Data

Jul. 27, 2009 (KR) ..... 10-2009-0068324
Jul. 27, 2009 (KR) ..... 10-2009-0068327
Mar. 25, 2010 (KR) ..... 10-2010-0026750

(51) Int. Cl.
*F28D 1/03* (2006.01)
*F28F 3/04* (2006.01)
*F28D 9/00* (2006.01)

(52) U.S. Cl.
CPC ..... *F28D 1/0333* (2013.01); *F28D 9/0043* (2013.01); *F28F 3/046* (2013.01)

(58) Field of Classification Search
CPC ... F28D 9/0043; F28D 9/0031; F28D 9/0037; F28D 9/005; F28D 9/0056; F28D 1/0308; F28D 1/0375; F28D 1/0333; F28F 3/046; F28F 3/048; F28F 3/005; F28F 3/12; F28F 3/00; F28F 3/025; F28F 3/04; F28F 3/044; F28F 3/042; Y10T 29/49366
USPC ..... 165/165, 166, 167, 153, 152
See application file for complete search history.

(56) References Cited

U.S. PATENT DOCUMENTS 3,661,203 A * 5/1972 Mesher ..... 165/167
4,182,411 A * 1/1980 Sumitomo et al. ..... 165/110

(Continued)

FOREIGN PATENT DOCUMENTS

KR 10-2006-0130207 12/2006
KR 10-0892109 4/2009

(Continued)

*Primary Examiner* — Tho V Duong
(74) *Attorney, Agent, or Firm* — Novick, Kim & Lee, PLLC; Jae Youn Kim

(57) ABSTRACT

A plate heat exchanger realizing improved heat exchange performance by increasing the fluidity of fluids and by promoting turbulence of the fluids, including: heat exchange elements stacked by being laid one on top of another and individually formed by assembling upper and lower plates, with an internal flow channel defined in each of the heat exchange elements and an external flow channel defined between the heat exchange elements, the internal and external flow channels allowing internal and external fluids to pass therethrough, respectively, wherein the upper and lower plates are provided with respective wave patterns having ridges and valleys, each of the heat exchange elements has an inlet port and an outlet port, the upper and lower plates respectively have an upper flange and a lower flange which are assembled with each other through fitting, and first and second flat parts are formed around the upper and lower flanges.

8 Claims, 15 Drawing Sheets

(56) References Cited

U.S. PATENT DOCUMENTS

| | | | | |
|---|---|---|---|---|
| 5,193,612 | A * | 3/1993 | Stirnkorb | 165/167 |
| 6,016,865 | A * | 1/2000 | Blomgren | 165/148 |
| 2003/0131979 | A1* | 7/2003 | Kim | 165/164 |
| 2007/0000639 | A1* | 1/2007 | Ozawa et al. | 165/41 |
| 2007/0199687 | A1* | 8/2007 | Richter | 165/153 |
| 2011/0011568 | A1 | 1/2011 | Han et al. | |
| 2011/0088882 | A1* | 4/2011 | Persson | 165/170 |

FOREIGN PATENT DOCUMENTS

| | | |
|---|---|---|
| KR | 10-0892111 | 4/2009 |
| KR | 10-2009-0070758 | 7/2009 |

* cited by examiner

PLATE HEAT EXCHANGER

TECHNICAL FIELD

The present invention relates, in general, to a plate heat exchanger and, more particularly, to a plate heat exchanger which can realize improved heat exchange performance by increasing the fluidity of a fluid and by promoting turbulence of the fluid.

BACKGROUND ART

As well known in the related art, a heat exchanger is a device for transferring heat from a higher temperature fluid to a lower temperature fluid through a heat transfer wall, and a heat exchanger for automobiles is typically used in an air conditioning system, a transmission oil cooler, etc. Particularly, to accommodate the heat exchanger for automobiles in the limited space provided for its installation, it is required to realize compactness of the heat exchanger and, accordingly, a plate heat exchanger has been widely used.

The plate heat exchanger includes a plurality of heat exchange plates that are stacked to face each other and to define a flow channel between neighboring plates. The flow channel includes at least two flow channels through which different fluids flow. In the plate heat exchanger, the different fluids exchange heat with each other through the heat exchange plates when the fluids pass through the respective flow channels. Further, each of the respective plates has an inlet port and an outlet port in opposite ends thereof.

Further, to realize desired heat exchange performance of the plate heat exchanger, it is required to let the respective fluids smoothly flow without stagnating at specific locations and maintain a steady turbulence.

DISCLOSURE

Technical Problem

Accordingly, the present invention has been made keeping in mind the above problems occurring in the related art, and is intended to provide a plate heat exchanger which can realize improved heat exchange performance by increasing the fluidity of a fluid and by promoting turbulence of the fluid.

Technical Solution

In an aspect, the present invention provides a plate heat exchanger, including:

a plurality of heat exchange elements stacked in such a way that they are laid one on top of another, each of the heat exchange elements being formed by assembling an upper plate and a lower plate, with an internal flow channel defined in each of the heat exchange elements and allowing an internal fluid to pass therethrough, and an external flow channel defined between the heat exchange elements and allowing an external fluid to pass therethrough, wherein the upper plate is provided on an upper surface thereof with a wave pattern, the wave pattern of the upper plate comprising a plurality of ridges and a plurality of valleys, and the lower plate is provided on a lower surface thereof with a wave pattern, the wave pattern of the lower plate comprising a plurality of ridges and a plurality of valleys;

each of the heat exchange elements is provided at opposite ends thereof with an inlet port and an outlet port;

the upper plate has an upper flange which is raised upwards from each of the inlet and outlet ports, and the lower plate has a lower flange which protrudes downwards from each of the inlet and outlet ports, the upper flange and the lower flange being assembled with each other through fitting; and a first flat part is formed around each of the upper flanges of the upper plate and a second flat part is formed around each of the lower flanges of the lower plate.

The upper surface of the first flat part may be placed at a height which is same as that of an upper surface of each of the ridges of the upper plate, and an upper surface of the second flat part may be placed at a height which is same as that of a lower surface of each of the ridges of the lower plate.

The first flat part may be configured to surround the upper flange of the upper plate, and the second flat part may be configured to surround the lower flange of the lower plate.

The first flat part may be formed on a part of an area around the upper flange, and the wave pattern of the upper plate may extend to another part of the area around the upper flange.

The second flat part may be formed on a part of an area around the lower flange, and the wave pattern of the lower plate may extend to another part of the area around the lower flange.

The first flat part and the second flat part may be offset from each other in a diagonal direction on each of the inlet and outlet ports.

The first flat part may be provided with one or more first contact embossments, the first contact embossments protruding toward the lower plate.

The second flat part may be provided with one or more second contact embossments, the second contact embossments protruding toward the upper plate.

The lower surfaces of the first contact embossments may be in contact with upper surfaces of the second contact embossments.

The lower surfaces of the first contact embossments may be in contact with opposing surfaces of associated valleys of the lower plate, and the upper surfaces of the second contact embossments may be in contact with opposing surfaces of associated valleys of the upper plate.

The lower surfaces of the first contact embossments and the upper surfaces of the second contact embossments may have widths wider than those of the opposing surfaces of the valleys of the upper and lower plates.

Each of the heat exchange elements may be provided in an edge thereof with an edge channel communicating with the internal flow channel.

An upper subsidiary ridge and a lower subsidiary ridge may extend along edges of the upper and lower plates, respectively, with an upper subsidiary groove formed on an opposing surface of the upper subsidiary ridge and a lower subsidiary groove formed on an opposing surface of the lower subsidiary ridge, wherein the upper subsidiary groove and the lower subsidiary groove form the edge channel.

The upper plate and the lower plate may be respectively provided with first and second positioning embossments on front and rear ends of their edges, wherein a flat part may be formed by being depressed downwards in a center of the first positioning embossment, with a taper part formed around the flat part;

a flat part may be formed by being depressed downwards in a center of the second positioning embossment, with a taper part formed around the flat part; and the first positioning embossment may have a size smaller than that of the second positioning embossment and may be assembled with the second positioning embossment.

The width of the first positioning embossment may be smaller than that of the second positioning embossment, the thickness of the first positioning embossment may be thinner than that of the second positioning embossment, and the center of the first positioning embossment may be offset from the center of the second positioning embossment, so that a part of the taper part of the first positioning embossment may come into contact with a part of the taper part of the second positioning embossment.

The thickness of the second positioning embossment may be equal to the sum of the thickness of the upper spacing lug and the thickness of the lower spacing lug.

A support protrusion may be formed on the upper surface of the upper plate at a location close to the first positioning embossment.

Advantageous Effects

As described above, the plate heat exchanger according to the present invention is advantageous in that the fluids can smoothly flow with high fluidity in the areas around the inlet and outlet ports of the respective heat exchange elements and turbulence of the fluids is promoted, thereby remarkably improving the heat exchange efficiency of two or more fluids.

Another advantage of the present invention resides in that the subsidiary grooves are formed in the areas around the edges of the respective plates, so that the fluids can smoothly flow in the areas around the edges of the heat exchange elements and, accordingly, the fluids can evenly flow over the entire surface of heat exchange elements while being evenly distributed over the entire surface thereof, and, therefore, the present invention can remarkably improve the heat exchange efficiency of the fluids and can lessen the pressure reduction in the areas around the edges of the respective plates.

A further advantage of the present invention resides in that the contact embossments are formed on the flat parts of the upper and lower plates, so that the opposite ends of the upper and lower plates can be firmly assembled with each other and, accordingly, the respective heat exchange elements are reinforced to realize increased strength.

Yet another advantage of the present invention resides in that the first and second positioning embossments having different sizes can remarkably improve the stacking and assembling efficiency of the plurality of heat exchange elements, and can improve the assembling efficiency of the upper and lower plates, and can realize a firm assembly structure having increased structural strength.

MODE FOR INVENTION

Figure 1:
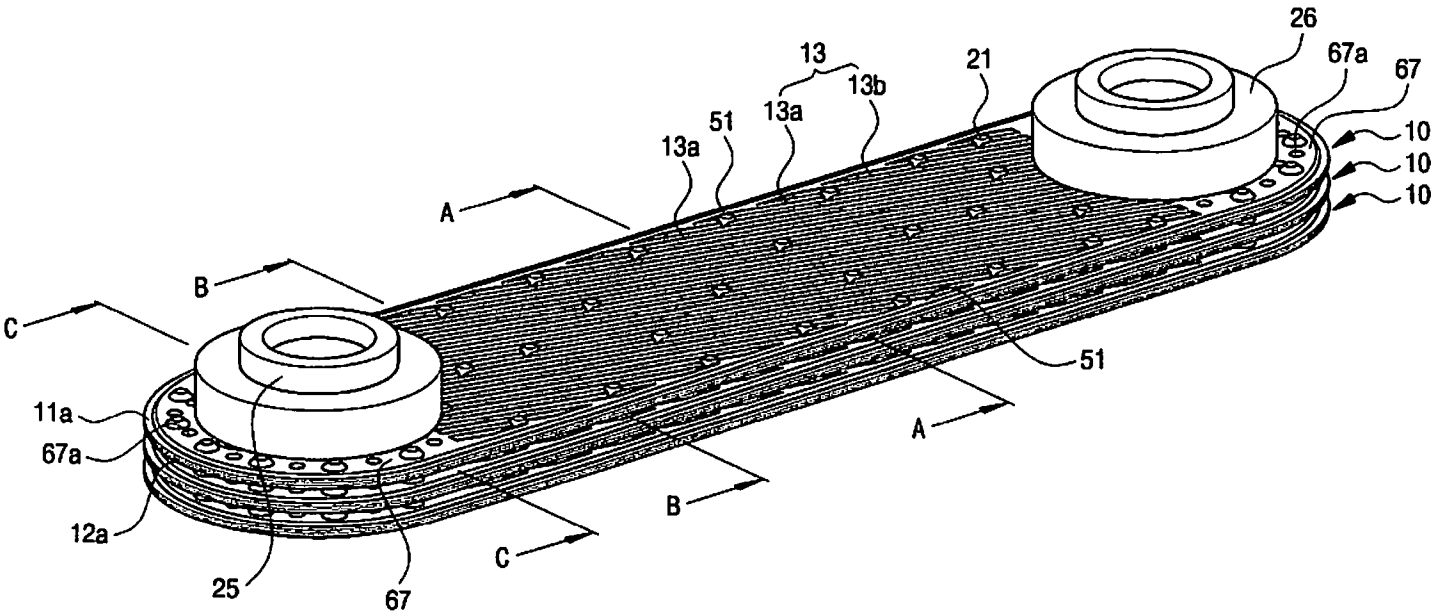
FIG. 1 is a perspective view illustrating a plate heat exchanger according to a first embodiment of the present invention.

Hereinbelow, a preferred embodiment of the present invention will be described in detail with reference to the accompanying drawings.

FIGS. 1 through 9 illustrate a plate heat exchanger according to a first embodiment of the present invention.

As shown in the drawings, the plate heat exchanger of the present invention includes a plurality of heat exchange elements 10 that are stacked in such a way that they are laid one on top of another.

Each of the heat exchange elements 10 defines therein an internal flow channel 18, through which an internal fluid, such as oil, passes. Each of the heat exchange elements 10 is formed by assembling an upper plate 11 with a lower plate 12 into a single structure. The upper plate 11 and the lower plate 12 are made of a metal material having excellent heat conductivity, such as aluminum, and may be joined together along edges 11*a* and 12*a* by brazing, etc.

As shown in FIGS. 1 through 9, a wave pattern is formed on the surface of the upper plate 11, in which a plurality of ridges 13*a* and a plurality of valleys 13*b* are alternately arranged to form the wave pattern. The wave pattern may be formed by subjecting the upper plate 11 to die-casting or pressing, such as stamping. The ridges 13*a* and the valleys 13*b* are diagonally elongated on a plane, with a groove 11*b* formed on an opposing surface of each of the ridges 13*a*.

In the same manner, a wave pattern is formed on the surface of the lower plate 12, in which a plurality of ridges 14*a* and a plurality of valleys 14*b* are alternately arranged to form the wave pattern, as shown in FIGS. 1 through 9. The wave pattern may be formed by subjecting the lower plate 12 to die-casting or pressing, such as stamping. The ridges 14*a* and the valleys 14*b* are diagonally elongated on a plane, with a groove 12*b* formed on an opposing surface of each of the ridges 14*a*.

Figure 5:
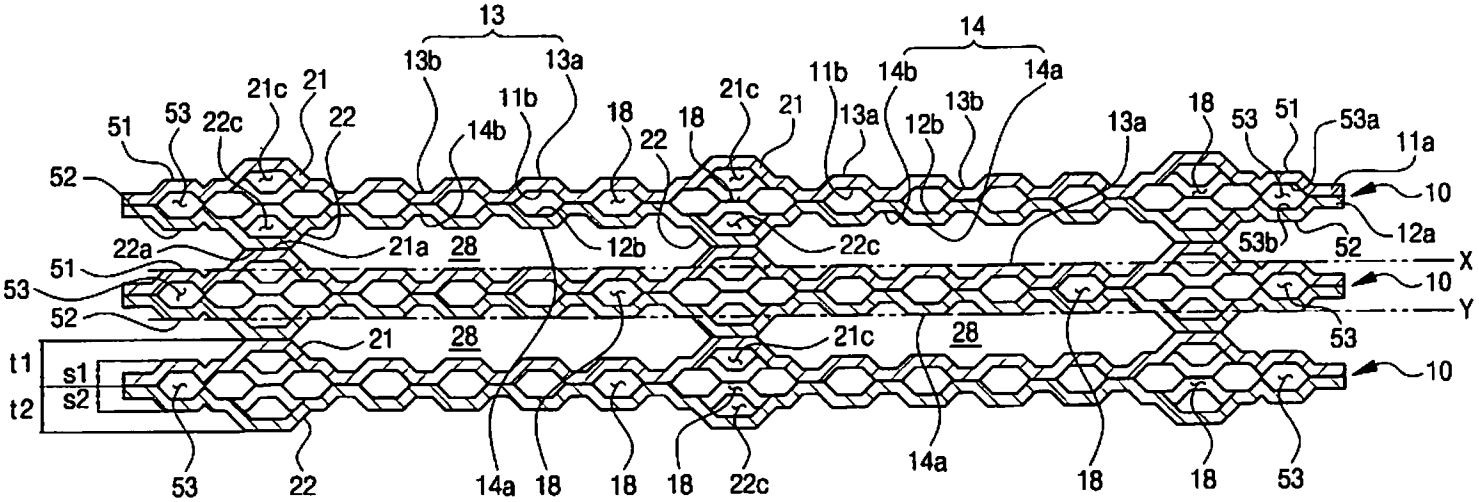
FIG. 5 is a sectional view taken along line A-A of FIG. 1.
Figure 6:
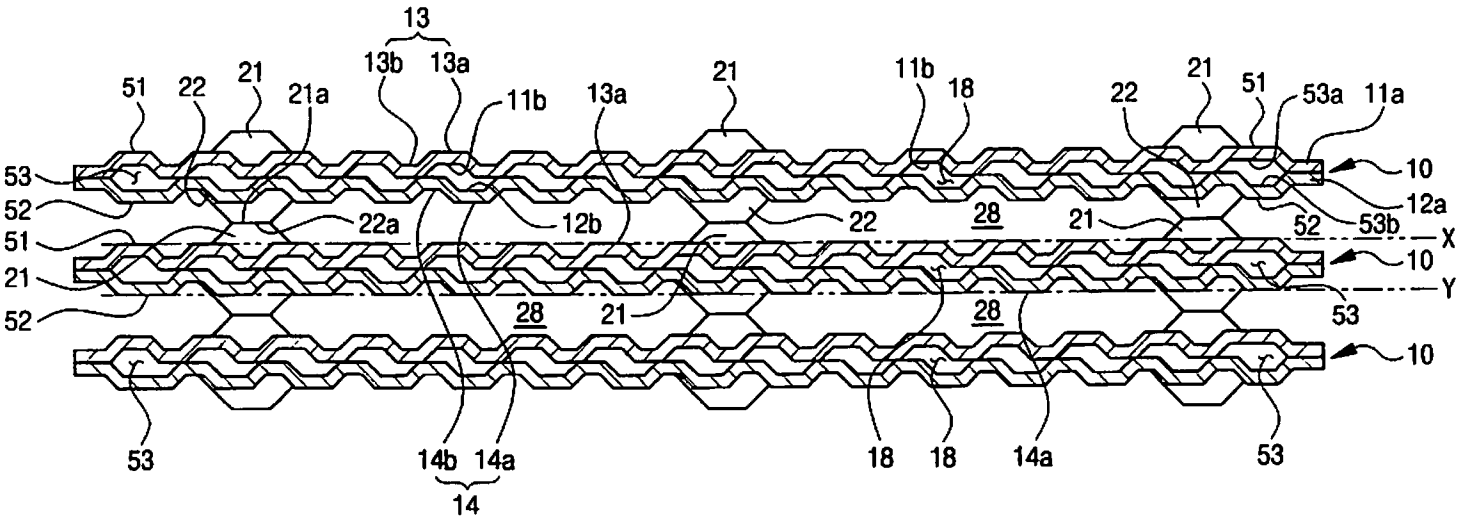
FIG. 6 is a sectional view taken along line B-B of FIG. 1.

When the upper plate 11 and the lower plate 12 are joined with each other along the edges 11*a* and 12*a* thereof, the lower surface of the upper plate 11 faces the upper surface of the lower plate 12, wherein the wave pattern of the upper plate 11 intersects with the wave pattern of the lower plate 12. Here, the grooves 11*b* of the upper plate 11 and the grooves 12*b* of the lower plate 12 are arranged in such a way that they face each other and intersect with each other, thereby defining the internal flow channel 18 having an intersecting structure. Therefore, oil can flow zigzag through the internal flow channel 18 having the intersecting structure, so that the amount of the internal fluid flowing in the internal flow channel 18 can be increased and the contact surface of the internal fluid can be enlarged to realize improved heat exchange efficiency. Further, as shown in FIGS. 5 and 6, the opposing surfaces of the valleys 13*b* formed in the upper plate 11 and the opposing surfaces of the valleys 14*b* formed in the lower plate 12 may be partially joined to each other in such a way that they intersect with each other.

Further, an external fluid, such as cooling water, passes through an external flow channel 28 which is defined between the neighboring heat exchange elements 10 that are stacked. That is, the external flow channel 28 is defined outside the heat exchange elements 10. In other words, the external flow channel 28 is defined between the neighboring heat exchange elements 10 because the plurality of heat exchange elements 10 are stacked in such a way that they are laid one on top of another and they are spaced apart from each other by a predetermined interval.

Further, the upper and lower surfaces of each of the heat exchange elements 10, that is, the upper surface of the upper plate 11 and the lower surface of the lower plate 12 are respectively provided with a plurality of upper spacing lugs 21 and a plurality of lower spacing lugs 22, which individually protrude.

Figure 3:
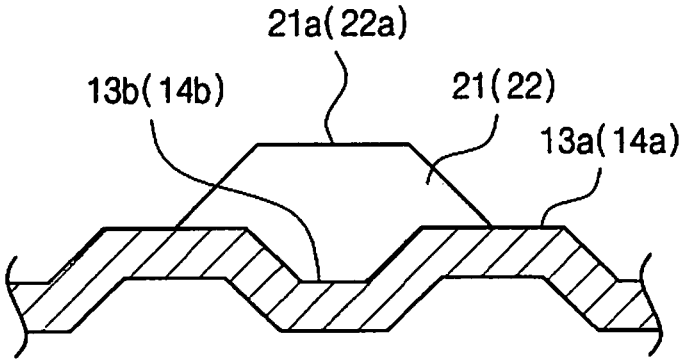
FIG. 3 is a sectional view illustrating a part taken along line D-D of FIG. 1.

Further, to improve the heat exchange efficiency of the internal fluid passing through the internal flow channel 18, it is preferred that there be an increased number of ridges 13*a*, 14*a*. To increase the number of the ridges 13*a*, 14*a*, it is required to reduce the pitch of the ridges 13*a*, 14*a*. To reduce the pitch of the ridges 13*a*, 14*a*, each of the upper spacing lugs 21 is formed in such a way that the upper spacing lug 21 intersects with two or more ridges 13*a* on the upper surface of the upper plate 11, as shown in FIG. 3, so that the upper spacing lug 21 is located on one or more valleys 13*b* defined between the ridges 13*a*. In the same manner, each of the lower spacing lugs 22 is formed in such a way that the lower spacing lug 22 intersects with two or more ridges 14*a* on the lower surface of the lower plate 12, so that the lower spacing lug 22 is located on one or more valleys 14*b* defined between the ridges 14*a*. Because each of the upper and lower spacing lugs 21 and 22 is formed in a state in which the lug 21, 22 intersects with two or more ridges 13*a*, 14*a*, as described above, it is possible to reduce the pitch of the ridges 13*a*, 14*a* and to remarkably increase the degrees of freedom in the design of the wave pattern (pitch, etc.) of the upper and lower plates 11 and 12, and to realize the improved heat exchange performance of the plates 11 and 12.

Figure 4:
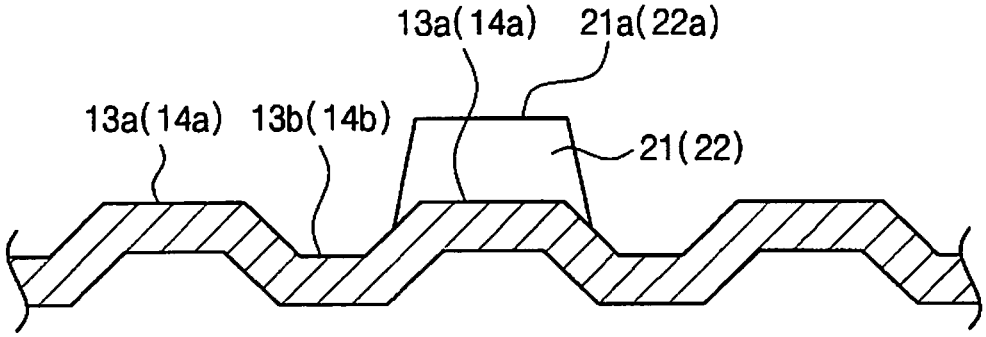
FIG. 4 is a sectional view corresponding to FIG. 3, but illustrating a modification of the first embodiment.

Alternatively, the upper spacing lug 21 of the present invention may be located on the upper surface of a ridge 13*a* of the upper plate 11, and the lower spacing lug 22 may be formed on the lower surface of a ridge 14*a* of the lower plate 12, as shown in FIG. 4.

Each of the upper and lower spacing lugs 21 and 22 may be shaped in the form of any one of a trapezoidal cross-section, a curved cross-section, such as a circular or elliptical cross-section, and a square cross-section. Further, the upper surfaces 21*a* of the upper spacing lugs 21 and the lower surfaces 22*a* of the lower spacing lugs 22 are shaped in the form of a flat surface, as shown in FIGS. 5 and 6, so that the close joining of the upper and lower plates 11 and 12 can be more easily accomplished.

As shown in FIG. 5, the heights t1 and t2 of the upper and lower spacing lugs 21 and 22 are higher than both the height s1 of the ridges 13*a* of the upper plate 11 and the height s2 of the ridges 14*a* of the lower plate 12. Therefore, the neighboring upper and lower spacing lugs 21 and 22 which face each other in a vertical direction can be joined to each other. Described in detail, the lower spacing lugs 22 of an upper heat exchange element 10 come into contact with the upper spacing lugs 21 of a lower heat exchange element 10. Because the plurality of upper and lower spacing lugs 21 and 22 are brought into contact with each other as described above, the interval between the stacked heat exchange elements 10 is increased and, accordingly, the sectional area of the external flow channel 28 is increased. Further, the spacing lugs 21 and 22 which are in contact with each other may be joined to each other by brazing, etc. The upper spacing lugs 21 and the lower spacing lugs 22 are located on points, at which the ridges 13*a* of the upper plate 11 and the ridges 14*a* of the lower plate 12 intersect with each other, in such a way that the upper and lower spacing lugs 21 and 22 correspond to each other, so that the stacked structure of the heat exchange elements can have a stable structure.

Further, as shown in FIG. 5, respective cavities 21*c* and 22*c* are defined in the upper and lower spacing lugs 21 and 22. The cavities 21*c* and 22*c* are configured to communicate with associated grooves 11*b* and 12*b* of the upper and lower plates 11 and 12, so that the internal fluid can flow in the cavities 21*c* and 22*c* of the upper and lower spacing lugs 21 and 22, thereby improving the heat exchange performance.

Figure 2:
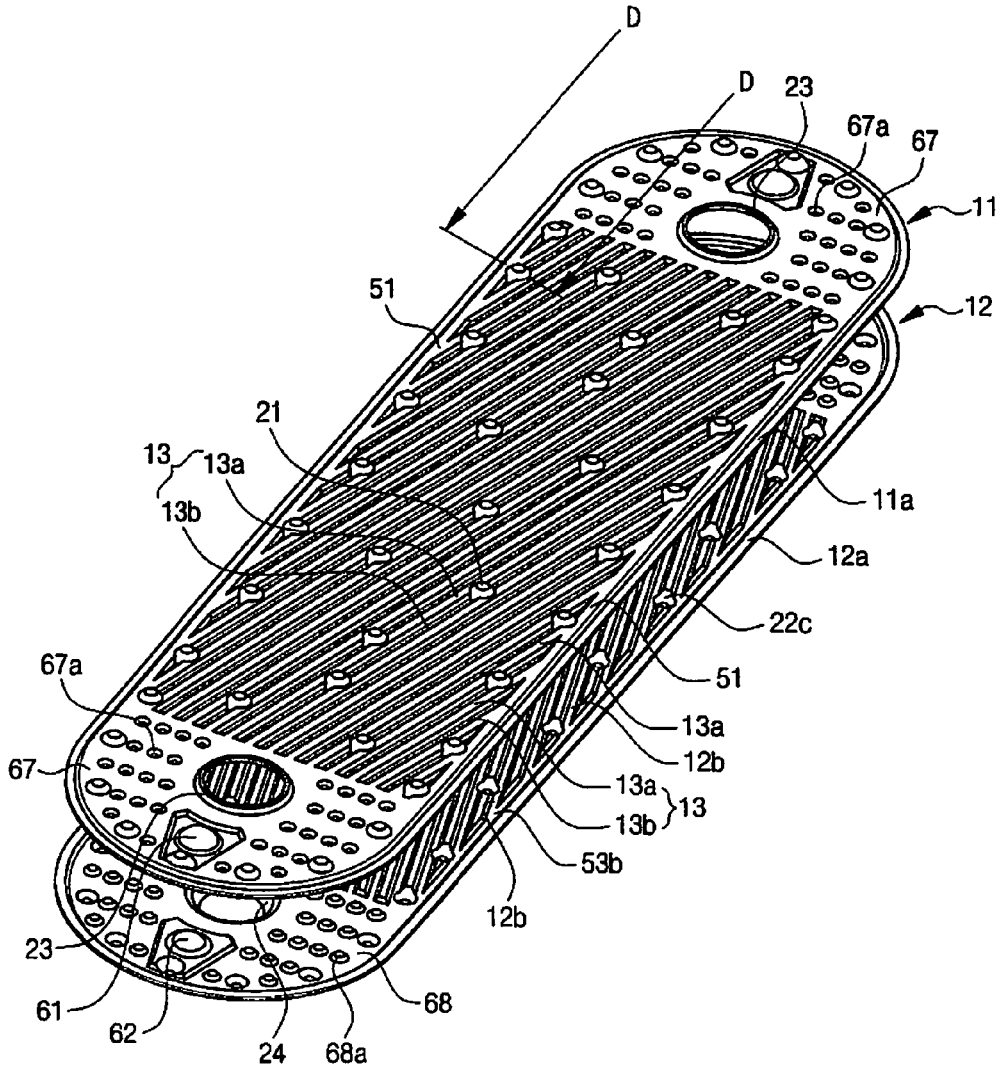
FIG. 2 is an exploded perspective view illustrating upper and lower plates of the plate heat exchanger according to the first embodiment of the present invention.
Figure 7:
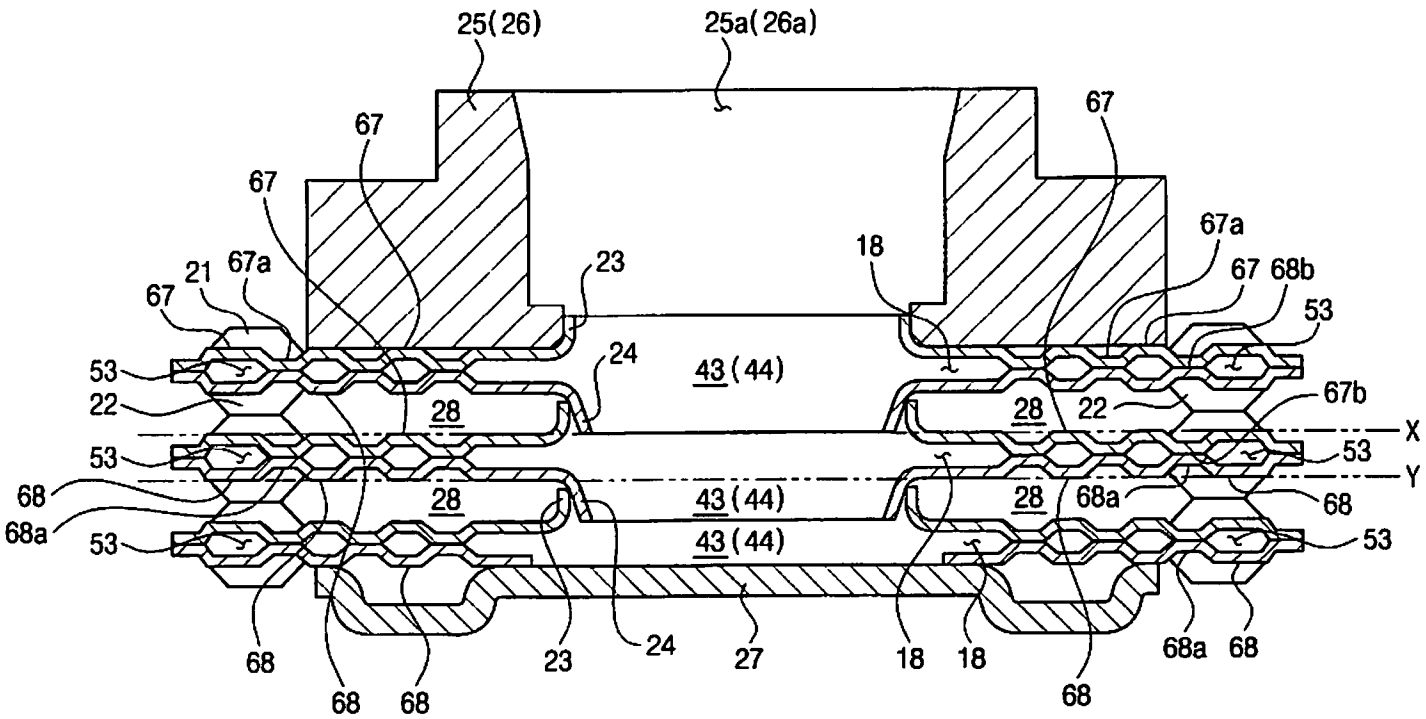
FIG. 7 is a sectional view taken along line C-C of FIG. 1.
Figure 8:
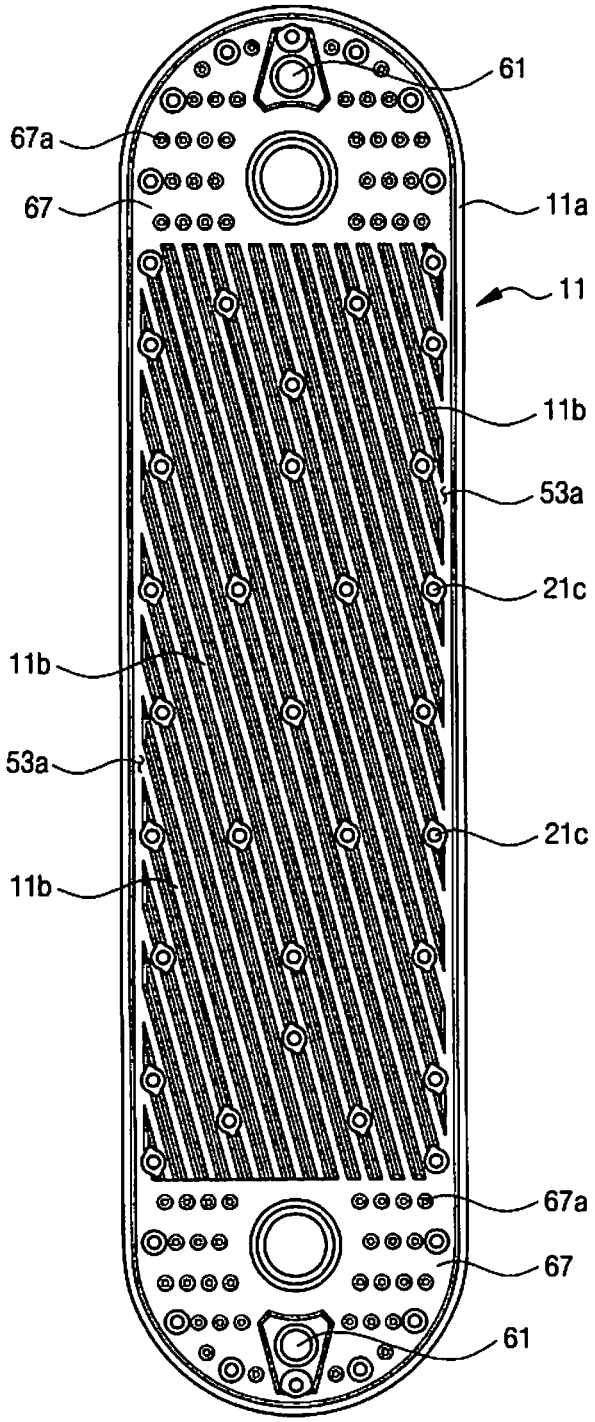
FIG. 8 is a bottom view illustrating a lower surface of the upper plate shown in FIG. 2.
Figure 9:
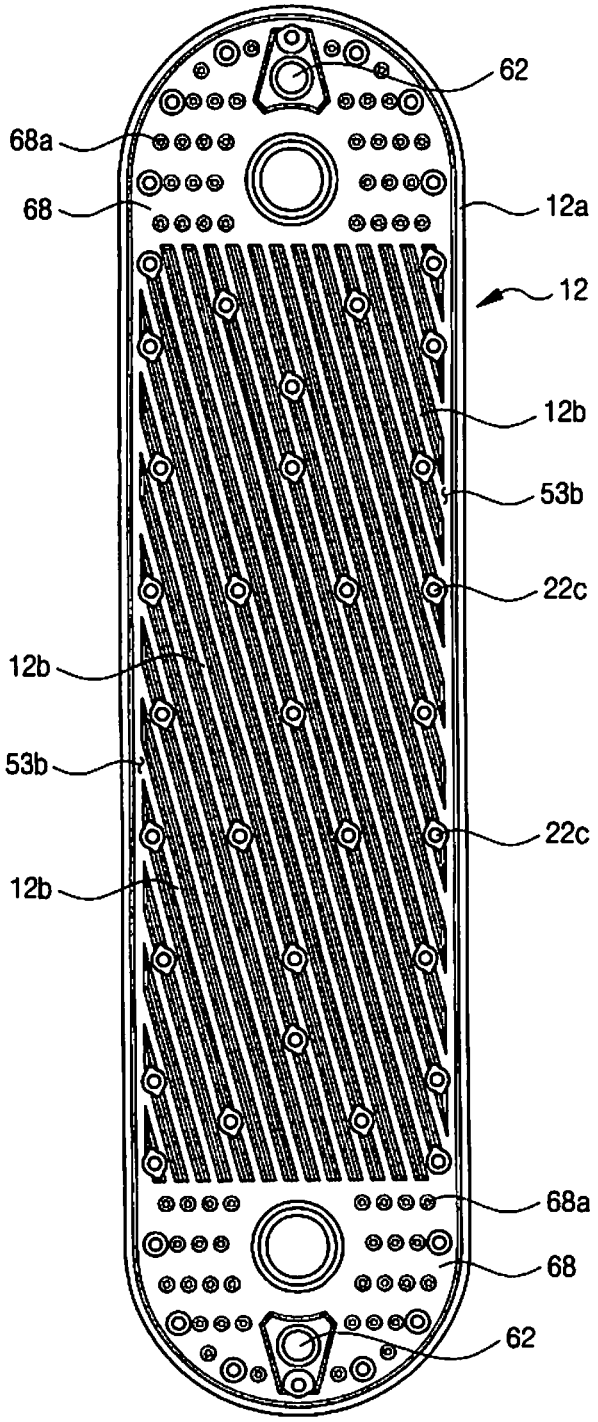
FIG. 9 is a plane view illustrating an upper surface of the lower plate shown in FIG. 2.
Figure 10:
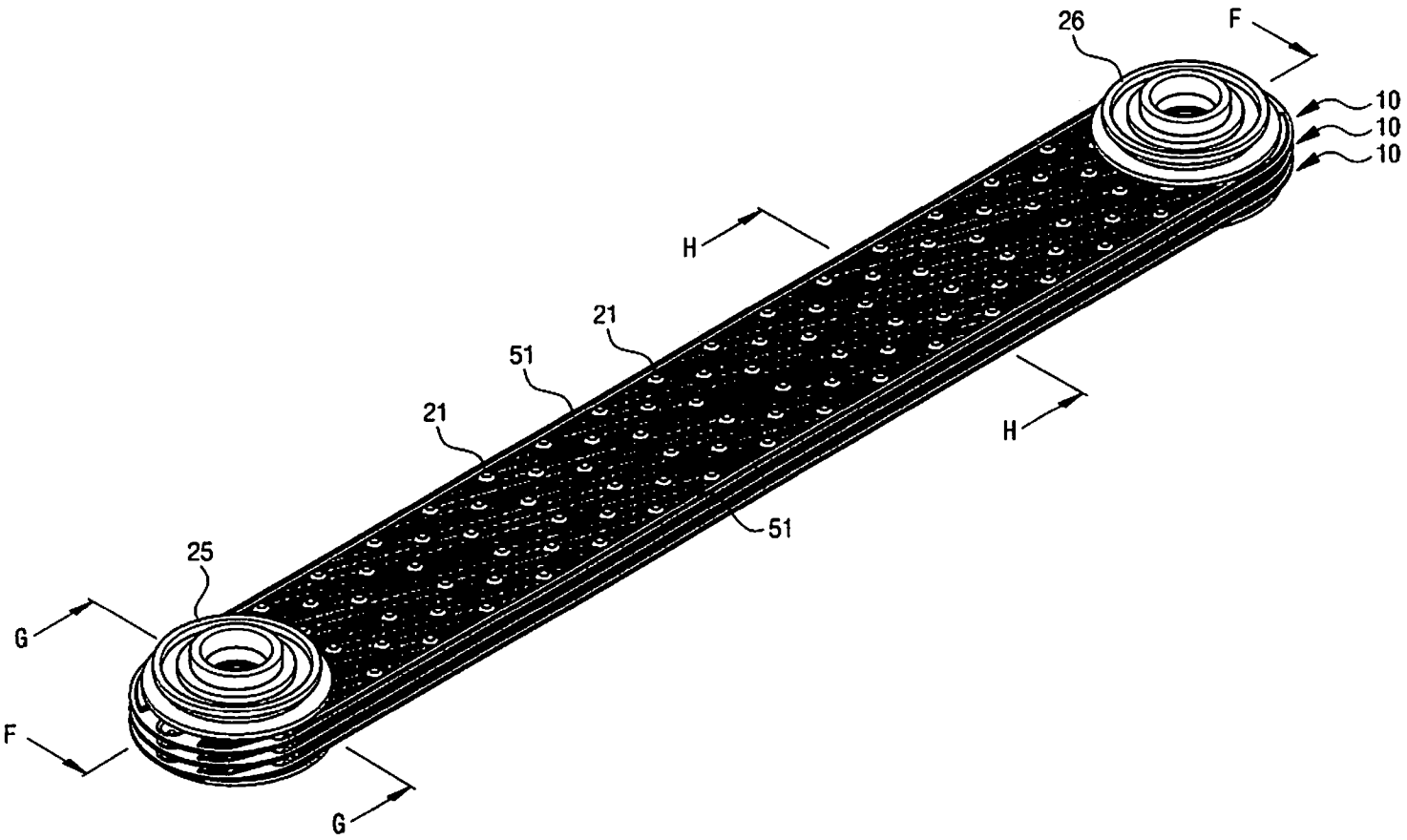
FIG. 10 is a perspective view illustrating a plate heat exchanger according to a second embodiment of the present invention.

As shown in FIGS. 2 and 7, each of the heat exchange elements 10 is provided at opposite ends thereof with an inlet port 43 and an outlet port 44. In each of the heat exchange elements 10, the inlet port 43 and the outlet port 44 communicate with the internal flow channel 18. However, the inlet ports 43 and the outlet ports 44 of the heat exchange elements 10 are hermetically sealed from the external flow channel 28. Further, the plurality of the heat exchange elements 10 are stacked in such a way that the inlet ports 43 and the outlet ports 44 communicate with each other.

As shown in FIG. 7, the upper plate 11 has an upper flange 23 which is raised upwards from each of the inlet and outlet ports 43 and 44, and the lower plate 12 has a lower flange 24 which protrudes downwards from each of the inlet and outlet ports 43 and 44. Here, the upper flange 23 and the lower flange 24 are assembled with each other through fitting. In other words, the upper flanges 23 of a lower heat exchange element 10 may be fitted over the respective lower flanges 24 of an upper heat exchange element 10 or the lower flanges 24 of an upper heat exchange element 10 may be fitted into the respective upper flanges 23 of a lower heat exchange element 10, so that the desired fluid tightness can be realized. Alternatively, the neighboring upper and lower flanges 23 and 24 may be integrated with each other by brazing, etc. in a leak proof manner. Therefore, the inlet ports 43 and the outlet ports 44 of the heat exchange elements 10 are hermetically sealed from the external flow channel 28.

Further, in the uppermost heat exchange element 10, an inlet fitting 25 is mounted to the upper flange 23 of the inlet port 43 and an outlet fitting 26 is mounted to the upper flange 23 of the outlet port 44, as shown in FIGS. 1 and 7. The inlet fitting 25 has an opening 25*a* to which an inlet pipe is connected. The outlet fitting 26 has an opening 26*a* to which an outlet pipe is connected.

Further, in the lowermost heat exchange element 10, a plug 27 is mounted to each of the lower flanges 24 of the inlet and outlet ports 43 and 44. The plugs 27 close the lower ends of the respective inlet and outlet ports 43 and 44.

Further, as shown in FIGS. 2 and 7, a first flat part 67 is formed around each of the upper flanges 23 of the upper plate 11. Here, the first flat part 67 may be formed in such a way that it surrounds an associated upper flange 23. The upper surfaces (see the phantom line X in FIG. 7) of the first flat parts 67 are placed at the same height as those of the upper surfaces (see the phantom lines X in FIGS. 5 and 6) of the ridges 13*a* of the upper plate 11 (the phantom lines X shown in FIGS. 5 and 6 coincide with the phantom line X shown in FIG. 7).

Further, a second flat part 68 is formed around each of the lower flanges 24 of the lower plate 12. Here, the second flat part 68 may be formed in such a way that it surrounds an associated lower flange 24. The lower surfaces (see the phantom line X in FIG. 7) of the second flat parts 68 are placed at the same height as those of the lower surfaces (see the phantom lines Y in FIGS. 5 and 6) of the ridges 14*a* of the lower plate 12.

Due to the first and second flat parts 67 and 68, a flow space for allowing the internal fluid to flow therein is defined in the area around each of the inlet and outlet ports 43 and 44 of the heat exchange elements 10, so that the internal fluid can be smoothly guided to the grooves 11*b* and 12*b* of the internal flow channel 18 without stagnating in the areas around the inlet and outlet ports 43 and 44, thereby remarkably increasing the fluidity of the internal fluid.

In each of the first flat parts 67, a plurality of first contact embossments 67*a* are formed by depressing the flat part 67 in a direction toward the lower plate 12 and, in each of the second flat parts 68, a plurality of second contact embossments 68*a* are formed by depressing the flat part 68 in a direction toward the upper plate 11. The first contact embossments 67*a* and the second contact embossments 68*a* are welded to each other by brazing, etc. at the lower surfaces 67*b* of the first contact embossments 67*a* and at the upper surfaces 68*b* of the second contact embossments 68*a*.

Due to the first and second contact embossments 67*a* and 68*a*, the opposite ends of the upper and lower plates 11 and 12 can be firmly assembled with each other and, thereby, the respective heat exchange elements 10 can be structurally reinforced to realize increased strength.

Further, in each of the heat exchange elements 10 of the present invention, the contact embossments 67*a* and 68*a* are placed in the areas around the inlet and outlet ports 43 and 44, so that the present invention is advantageous in that it promotes turbulence of the internal and external fluids in the areas around the inlet and outlet ports 43 and 44.

Further, as shown in FIGS. 1 through 6, an upper subsidiary ridge 51 is formed around the edge 11*a* of the upper surface of the upper plate 11. Here, the upper subsidiary ridge 51 extends along the edge 11*a* of the upper plate 11 and is connected to the edge of the first flat part 67. An upper subsidiary groove 53*a* is formed on an opposing surface of the upper subsidiary ridge 51. The upper subsidiary groove 53*a* communicates with the grooves 11*b* of the upper plate 11. Particularly, the upper surface of the upper subsidiary ridge 51 may be placed at the same height (see the phantom lines X in FIGS. 5 and 6) as those of the upper surfaces of the ridges 13*a* of the upper plate 11.

Further, as shown in FIGS. 1 through 6, a lower subsidiary ridge 52 is formed around the edge 12*a* of the lower surface of the lower plate 12. Here, the lower subsidiary ridge 52 extends along the edge 12*a* of the lower plate 12 and is connected to the edge of the second flat part 68. A lower subsidiary groove 53*b* is formed on an opposing surface of the lower subsidiary ridge 52. The lower subsidiary groove 53*b* communicates with the grooves 12*b* of the lower plate 12. Particularly, the lower surface of the lower subsidiary ridge 52 may be placed at the same height (see the phantom lines Y in FIGS. 5 and 6) as those of the lower surfaces of the ridges 14*a* of the lower plate 12.

When the edges 11*a* and 12*a* of the upper and lower plates 11 and 12 are assembled with each other, the upper subsidiary groove 53*a* faces the lower subsidiary groove 53*b* so that an edge channel 53 is defined by the upper subsidiary groove 53*a* and the lower subsidiary groove 53*b*. The edge channel 53 is close to the edges of the upper and lower plates 11 and 12. The edge channel 53 communicates with the internal flow channel 18, the inlet port 43 and the outlet port 44.

Therefore, the internal fluid can smoothly flow along the edge channels 53 of the respective heat exchange elements 10, so that the internal fluid can evenly flow in the internal flow channels 18 of the stacked heat exchange elements 10 in a state in which the internal fluid is evenly distributed in the internal flow channels 18. Accordingly, the present invention is advantageous in that it can improve the efficiency of using the internal fluid, can remarkably improve the heat exchange efficiency of the internal fluid and, further, can lessen the pressure reduction of the internal fluid.

Further, as shown in FIG. 2, the upper plate 11 and the lower plate 12 are provided with respective positioning embossments 61 and 62, which are first and second positioning embossments, on the front and rear ends of their edges 11*a* and 12*a*. The first and second positioning embossments 61 and 62 are configured in such a way that they can be assembled with each other by fitting. Due to the first and second positioning embossments 61 and 62, it is easy to position the upper and lower plates 11 and 12 and, accordingly, the preassembly of the upper and lower plates 11 and 12 can be quickly accomplished, and, thereby, the upper and lower plates 11 and 12 can be firmly and precisely assembled with each other.

FIGS. 10 through 16 illustrate a plate heat exchanger according to a second embodiment of the present invention.

Figure 11:
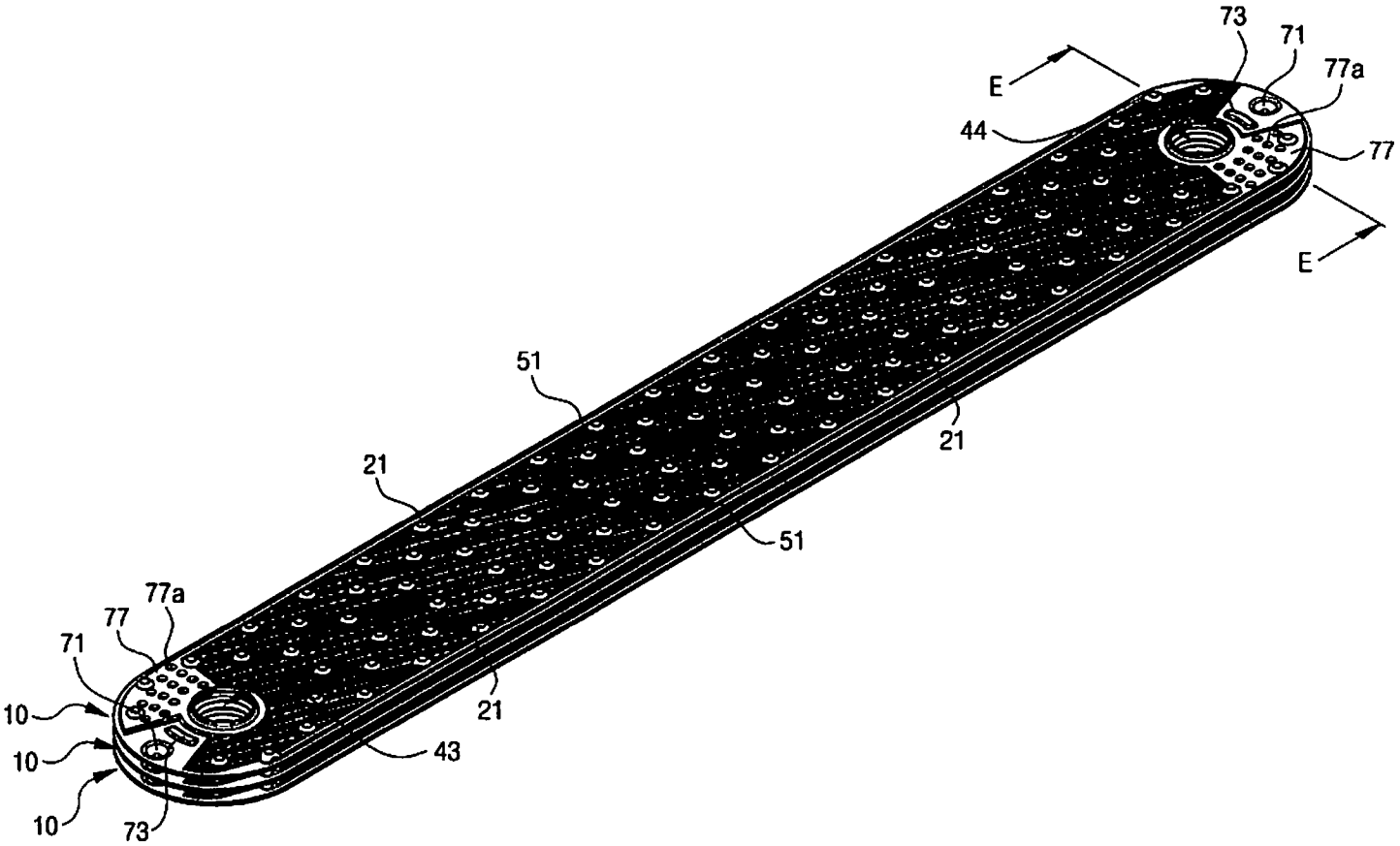
FIG. 11 is a perspective view illustrating a state in which both an inlet fitting and an outlet fitting are omitted from FIG. 10.
Figure 12:
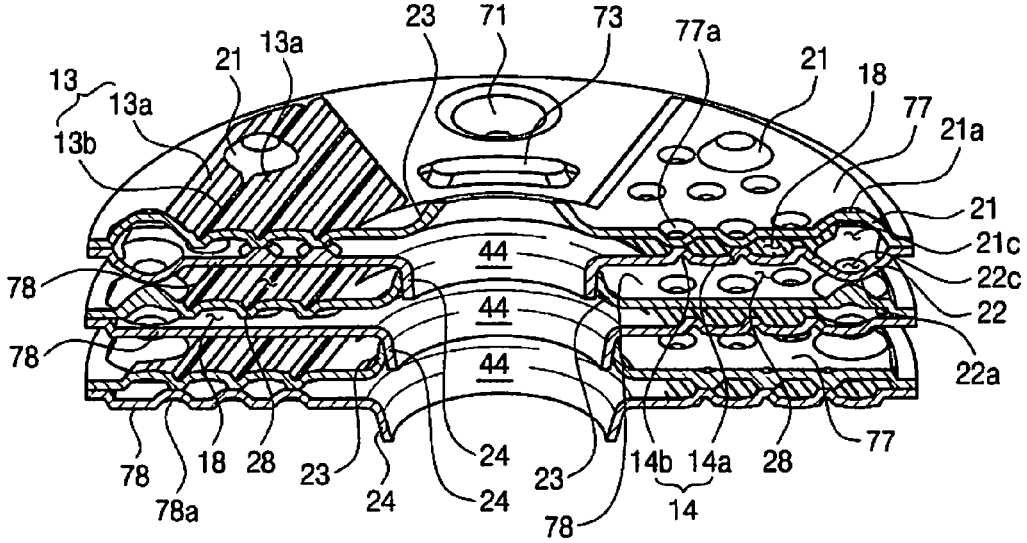
FIG. 12 is a partially sectioned view taken along line E-E of FIG. 11.
Figure 13:
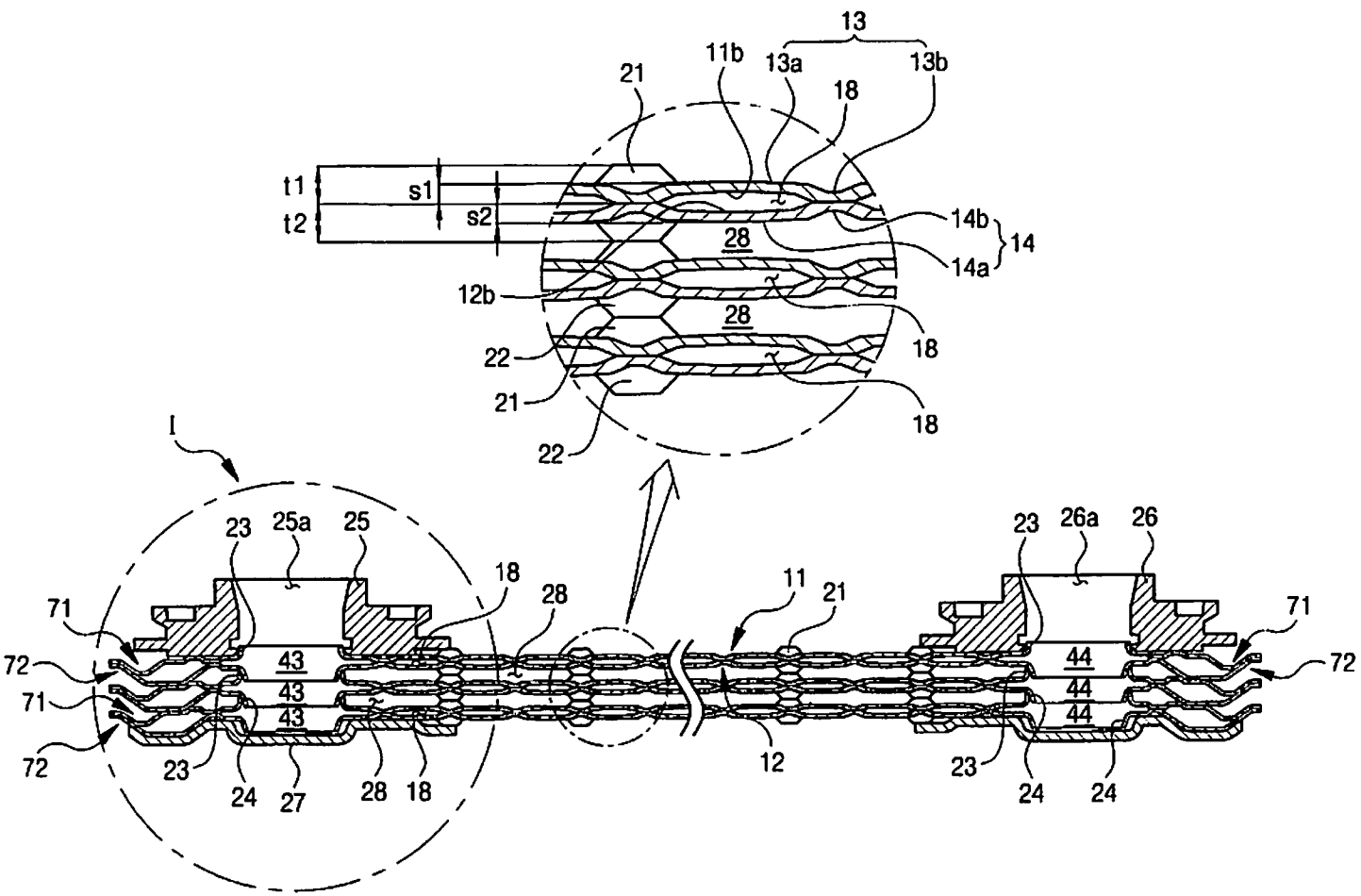
FIG. 13 is a sectional view taken along line F-F of FIG. 10.
Figure 15:
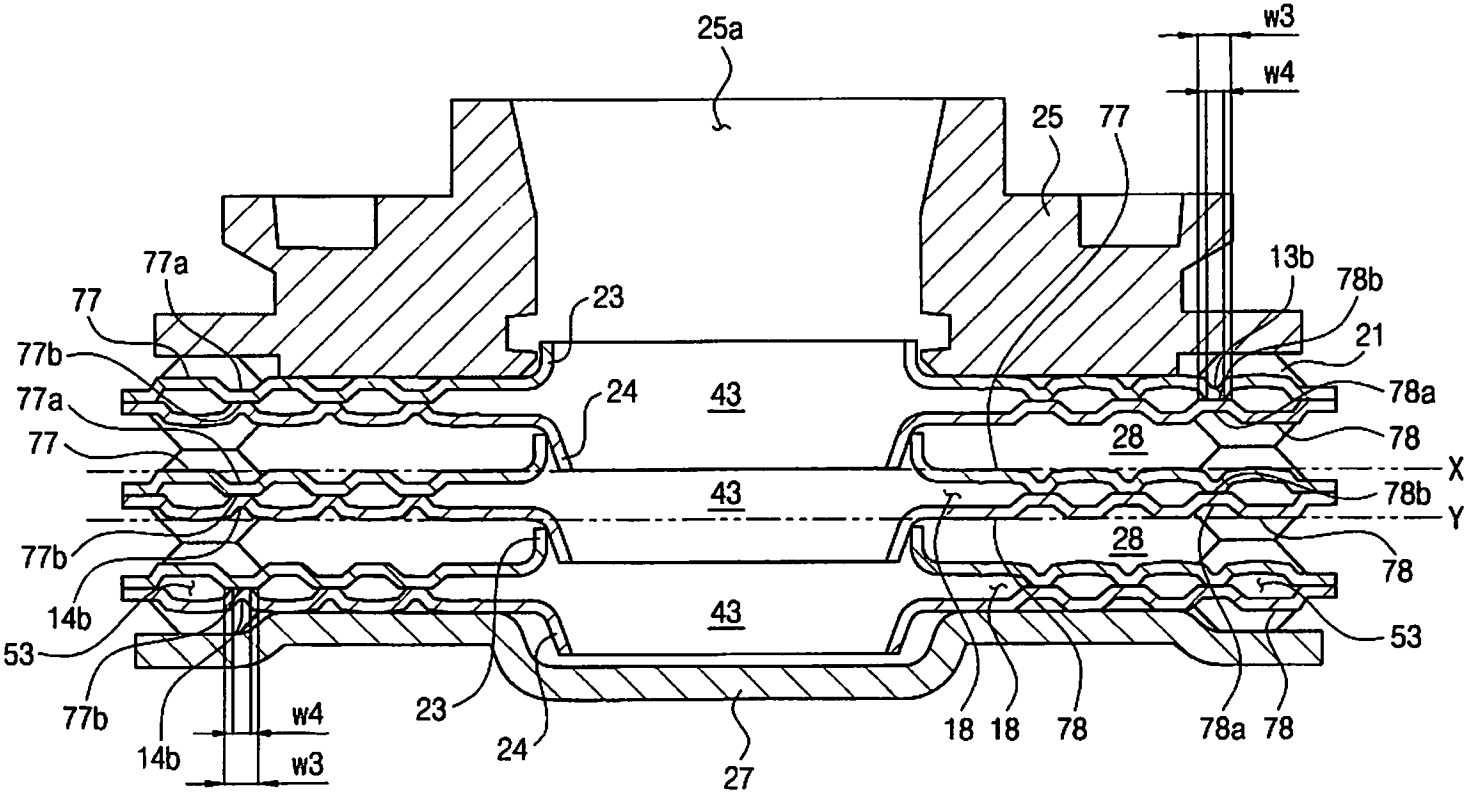
FIG. 15 is a sectional view taken along line G-G of FIG. 10.
Figure 16:
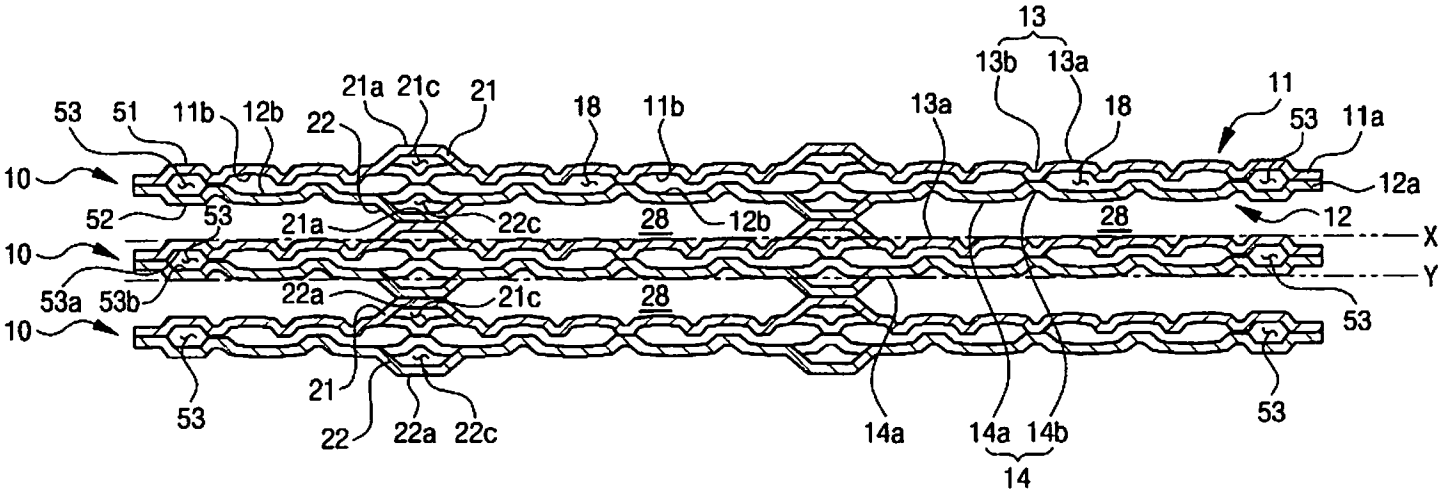
FIG. 16 is a sectional view taken along line H-H of FIG. 10.

As shown in FIG. 11, FIG. 12 and FIG. 15, a first flat part 77 is formed on each end of the upper plate 11, that is, the first flat part 77 is formed on one part of the area around each of the upper flanges 23 of the upper plate 11, and a wave pattern 13 extends to the other part of the area around each of the upper flanges 23, so that the first flat parts 77 partially surround the associated upper flanges 23. Further, the upper surfaces (see the phantom line X in FIG. 15) of the first flat parts 77 are placed at the same height as those of the upper surfaces (see the phantom line X in FIG. 16) of the ridges 13*a* of the upper plate 11.

Further, a second flat part 78 is formed on each end of the lower plate 12, that is, the second flat part 78 is formed on one part of the area around each of the lower flanges 24 of the lower plate 12, and a wave pattern 14 extends to the other part of the area around each of the lower flanges 24, so that the second flat parts 78 partially surround the associated lower flanges 24. Further, the lower surfaces (see the phantom line Y in FIG. 15) of the second flat parts 78 are placed at the same height as those of the lower surfaces (see the phantom line Y in FIG. 16) of the ridges 14*a* of the lower plate 12.

Here, as shown in FIG. 11, FIG. 12 and FIG. 15, the first flat part 77 of the upper plate 11 and the second flat part 78 of the lower plate 12 are arranged in such a way that the first and second flat parts 77 and 78 are offset from each other in a diagonal direction on each of the inlet and outlet ports 43 and 44 of the respective heat exchange elements 10. Due to the offset first and second flat parts 77 and 78, the internal fluid can be smoothly guided to the grooves 11*b* and 12*b* of the internal flow channel 18 without stagnating in the areas around the inlet and outlet ports 43 and 44, thereby remarkably increasing the fluidity of the internal fluid.

In each of the first flat parts 77, a plurality of first contact embossments 77*a* are formed by depressing the flat part 77 in a direction toward the lower plate 12 and, in each of the second flat parts 78, a plurality of second contact embossments 78*a* are formed by depressing the flat part 78 in a direction toward the upper plate 11. The first contact embossments 77*a* of the first flat parts 77 are brought into contact with the opposing surfaces of the associated valleys 14*b* of the lower plate 12 at the lower surfaces 77*b* of the first contact embossments 77*a* and are welded thereto by brazing, etc. In a similar manner, the second contact embossments 78*a* of the second flat parts 78 are brought into contact with the opposing surfaces of the associated valleys 13*b* of the upper plate 11 at the upper surfaces 78*b* of the second contact embossments 78*a* and are welded thereto by brazing, etc. Due to the first and second contact embossments 77*a* and 78*a*, the first and second flat parts 77 and 78 can be firmly assembled with the opposing surfaces of the valleys 13*b* and 14*b* of the upper and lower plates 11 and 12.

Here, the widths w3 of the lower and upper surfaces 77*b* and 78*b* of the first and second contact embossments 77*a* and 78*a* are larger than the widths w4 of the opposing surfaces of the valleys 13*b* and 14*b* formed in the upper and lower plates 11 and 12. Therefore, the contact embossments 77*a* and 78*a* can be stably welded to the valleys 13*b* and 14*b* of the upper and lower plates 11 and 12.

Due to the contact embossments 77*a* and 78*a*, the opposite ends of the upper and lower plates 11 and 12 can be firmly assembled with each other and, thereby, the respective heat exchange elements 10 can be structurally reinforced to realize increased strength.

Further, in each of the heat exchange elements 10, the contact embossments 77*a* and 78*a* are placed in the areas around the inlet and outlet ports 43 and 44, so that the present invention is advantageous in that it promotes turbulence of the internal and external fluids in the areas around the inlet and outlet ports 43 and 44.

Figure 14:
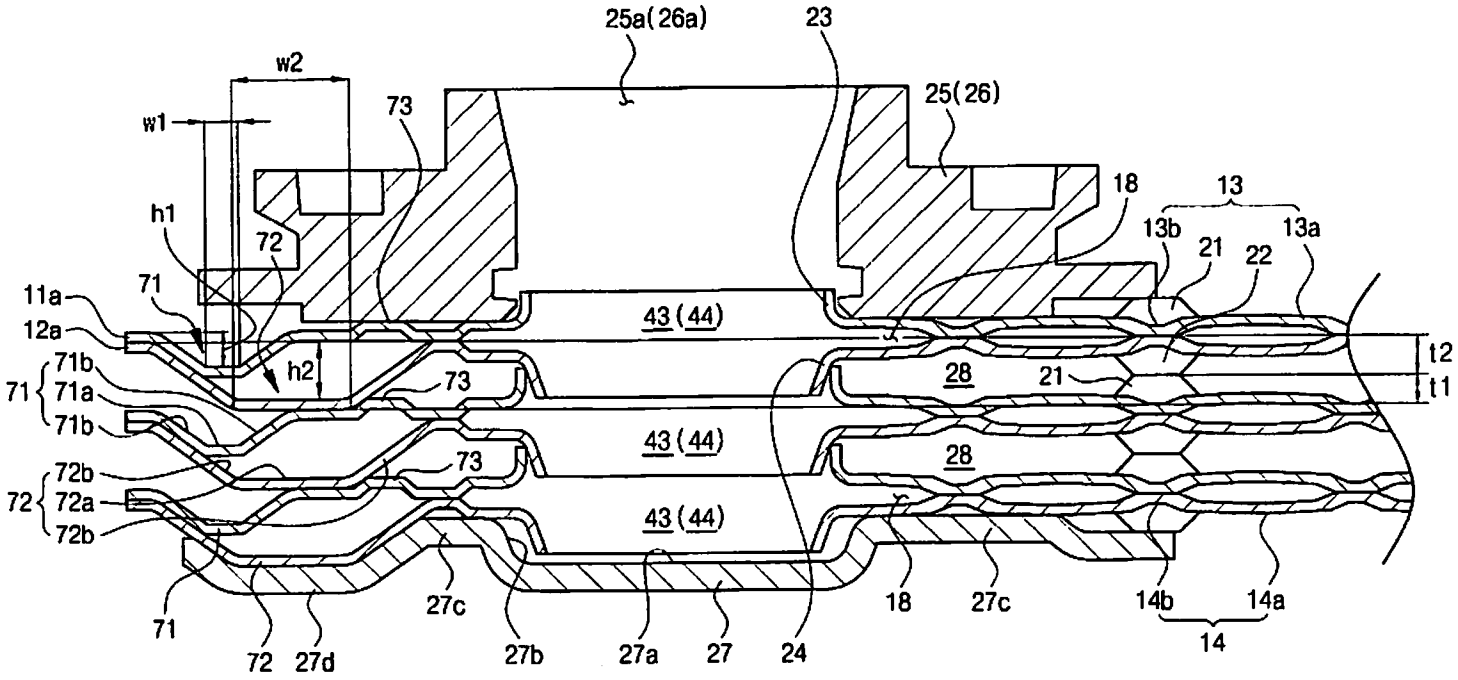
FIG. 14 is an enlarged view illustrating the portion designated by the arrow I in FIG. 13.

Further, as shown in FIGS. 11 and 14, the upper plate 11 and the lower plate 12 are provided with respective positioning embossments 71 and 72, which are first and second positioning embossments, on the front and rear ends of their edges 11*a* and 12*a*. Due to the first and second positioning embossments 71 and 72, it is easy to position the upper and lower plates 11 and 12 and, accordingly, the preassembly of the upper and lower plates 11 and 12 can be quickly accomplished, and, thereby, the upper and lower plates 11 and 12 can be firmly and precisely assembled with each other.

In the center of each of the first positioning embossments 71, a flat part 71*a* is formed by being depressed downwards, with a taper part 71*b* formed around the flat part 71*a*. In the same manner, a flat part 72*a* is formed by being depressed downwards in the center of each of the second positioning embossments 72, with a taper part 72*b* formed around the flat part 72*a*. Here, the width w1 of each of the first positioning embossments 71 is smaller than the width w2 of each of the second positioning embossments 72, and the thickness h1 of the first positioning embossment 71 is thinner than the thickness h2 of the second positioning embossment 72, and the center of the first positioning embossment 71 is offset from the center of the second positioning embossment 72. Therefore, a part of the taper part 71*b* of each of the first positioning embossments 71 comes into contact with a part of the taper part 72*b* of an associated second positioning embossment 72 and is welded thereto by brazing, etc.

Further, as shown in FIG. 14, the thickness h2 of the second positioning embossment 72 is equal to the sum of the thickness t1 of the upper spacing lug 21 and the thickness t2 of the lower spacing lug 22, that is, h2=t1+t2. Therefore, the flat part 72*a* of the second positioning embossment 72 formed in the lower plate 12 of a heat exchange element 10 comes into contact with the upper surface of the upper plate 11 of a lower heat exchange element 10. As described above, when the second positioning embossments 72 are configured to be supported by the upper plates 11 of the heat exchange elements 10 stacked in such a way that they are laid one on top of another, it is possible to realize a structure in which the front and rear ends of the edges 11*a* and 12*a* are firmly supported by each other. Therefore, the plate heat exchanger of the present invention is advantageous in that it is structurally reinforced to increase the structural strength thereof. Further, the flat part 72*a* of the second positioning embossment 72 of the lowermost plate 12 is supported by the plug 27.

Further, on the upper surface of the upper plate 11, a support protrusion 73 is formed at a location close to the first positioning embossment 71. The support protrusion 73 of the uppermost plate 11 supports the lower surfaces of the inlet and outlet fittings 25 and 26. The support protrusions of the remaining upper plates 11 support the lower surfaces of the flat parts 72*a* of the second positioning embossments 72 provided in the lower plates 12. Due to the support protrusions 73, the assembly structure of the plate heat exchanger of the present invention can be firm and stable.

Further, a depressed part 27*a* is formed in the center of plug 27, with a peripheral part 27*c* formed around the depressed part 27*a*. Further, a fitting groove part 27*d* is formed at a location outside the peripheral part 27*c* and receives the second positioning embossment 72 therein. The sidewall 27*b* of the depressed part 27*a* is configured in the form of an inclined wall. The periphery of the lower flange of the lowermost plate 12 comes into contact with the peripheral part 27*c* of the plug 27 and the lower plate 12 that is in contact with the peripheral part 27*c* of the plug 27 is assembled with the peripheral part 27*c* by brazing, etc.

The construction and operation of the second embodiment except for the above-mentioned contents remain the same as those of the first embodiment and further explanation is thus not deemed necessary.

The invention claimed is:

1. A plate heat exchanger, comprising:

a plurality of heat exchange elements stacked in such a way that one is laid on top of another, each of the heat exchange elements including an upper plate, a lower plate, and an internal flow channel defined in each of the heat exchange elements and allowing an internal fluid to pass therethrough; and an external flow channel defined between the heat exchange elements and allowing an external fluid to pass therethrough, wherein the upper plate is includes a wave pattern disposed on an upper surface thereof, the wave pattern of the upper plate comprising a plurality of ridges and a plurality of valleys, and the lower plate includes a wave pattern disposed on a lower surface thereof, the wave pattern of the lower plate comprising a plurality of ridges and a plurality of valleys, wherein each of the heat exchange elements includes an inlet port and an outlet port disposed at opposite ends thereof, wherein the upper plate has an upper flange which is raised upwards from each of the inlet and outlet ports, wherein the lower plate has a lower flange which protrudes downwards from each of the inlet and outlet ports, the upper flange and the lower flange being assembled with each other through fitting, wherein the upper plate includes a first flat part disposed around each of the upper flanges of the upper plate, wherein the lower plate includes a second flat part disposed around each of the lower flanges of the lower plate, wherein each of the heat exchange elements includes an edge channel disposed in an edge thereof and communicating with the internal flow channel, and wherein an upper subsidiary ridge and a lower subsidiary ridge extend along edges of the upper and lower plates, respectively, with an upper subsidiary groove disposed on an opposing surface of the upper subsidiary ridge and a lower subsidiary groove disposed on an opposing surface of the lower subsidiary ridge, wherein the upper subsidiary groove and the lower subsidiary groove define the edge channel.

2. The plate heat exchanger as set forth in claim 1, wherein an upper surface of the first flat part is placed at a height which is same as that of an upper surface of each of the ridges of the upper plate, and an upper surface of the second flat part is placed at a height which is same as that of a lower surface of each of the ridges of the lower plate.

3. The plate heat exchanger as set forth in claim 1, wherein the first flat part is configured to surround the upper flange of the upper plate, and the second flat part is configured to surround the lower flange of the lower plate.

4. The plate heat exchanger as set forth in claim 1, wherein the first flat part includes one or more first contact embossments, the first contact embossments protruding toward the lower plate; and the second flat part includes one or more second contact embossments, the second contact embossments protruding toward the upper plate.

5. The plate heat exchanger as set forth in claim 4, wherein lower surfaces of the first contact embossments are in contact with upper surfaces of the second contact embossments.

6. The plate heat exchanger as set forth in claim 1, wherein the upper surface of the upper plate includes a plurality of upper spacing lugs and the lower surface of the lower plate includes a plurality of lower spacing lugs, wherein a height of each of the upper spacing lugs is higher than that of each of the ridges of the upper plate and a height of each of the lower spacing lugs is higher than that of each of the ridges of the lower plate, and neighboring upper and lower spacing lugs which face each other in a vertical direction are joined to each other.

7. The plate heat exchanger as set forth in claim 6, wherein each of the upper spacing lugs intersects with two or more ridges on the upper surface of the upper plate, so that the upper spacing lug is located on one or more valleys, and each of the lower spacing lugs intersects with two or more ridges on the lower surface of the lower plate, so that the lower spacing lug is located on one or more valleys.

8. The plate heat exchanger as set forth in claim 6, wherein the upper and lower spacing lugs include respective cavities therein, the respective cavities communicating with the internal flow channel defined between the upper and lower plates.

* * * * *